US005145423A

United States Patent [19]

Kawai

[11] Patent Number: 5,145,423

[45] Date of Patent: Sep. 8, 1992

[54] TILTING MECHANISM FOR OUTBOARD DRIVE UNIT

[75] Inventor: Takaji Kawai, Hamamatsu, Japan

[73] Assignee: Sanshin Kogyo Kabushiki Kaisha, Hamamatsu, Japan

[21] Appl. No.: 685,124

[22] Filed: Apr. 12, 1991

[30] Foreign Application Priority Data

Apr. 12, 1990 [JP] Japan ..... 2-97079

[51] Int. Cl.[5] ..... B63H 21/26

[52] U.S. Cl. ..... 440/63

[58] Field of Search ..... 440/53, 55, 56, 63

[56] References Cited

U.S. PATENT DOCUMENTS 3,785,329 1/1974 Shimanckas ..... 440/55

4,726,797 2/1988 Taguchi ..... 440/63

4,759,733 7/1988 Nishimura ..... 440/55

FOREIGN PATENT DOCUMENTS 128898 6/1987 Japan ..... 440/55

*Primary Examiner*—Jesûs D. Sotelo

*Attorney, Agent, or Firm*—Ernest A. Beutler

[57] ABSTRACT

A tilting mechanism including a tilt locking mechanism for releasably retaining an outboard drive unit in a tilted down position and a tilt holding mechanism for releasably holding the outboard drive unit in a tilted up position is operable by a single operating lever that is movable between three positions. A detent mechanism is included for fixing each of the three operating lever positions.

16 Claims, 10 Drawing Sheets

*Figure 10*

| | Postitions of the Operating Lever 43 | | |
|---|---|---|---|
| | First Position | Second Position | Third Position |
| **Lock Arm 33** | In the locked position | In the released position | In the released position |
| **Holder Arm 45** | Urged away from holder portions | Urged away from holder portions | Urged toward the holder portions |

*Figure 11*

| | Postitions of the Operating Lever 43 | | |
|---|---|---|---|
| | First Position | Second Position | Third Position |
| **Lock Arm 33** | In the locked position | In the released position | In the locked position |
| **Holder Arm 45** | Urged away from holder portions | Urged away from holder portions | Urged toward the holder portions |

*Figure 12*

| | Postitions of the Operating Lever 43 | | |
|---|---|---|---|
| | First Position | Second Position | Third Position |
| **Lock Arm 33** | In the locked position | In the released position | In the locked position |
| **Holder Arm 45** | Urged away from holder portions | Urged toward the holder portions | Urged toward the holder portions |

TILTING MECHANISM FOR OUTBOARD DRIVE UNIT

BACKGROUND OF THE INVENTION

This invention relates to a tilting mechanism for an outboard drive unit, and more particularly to an improved tilt locking and holding mechanism which employs a single operating lever for operating both a lock arm that selectively retains the drive unit in a tilted down position and a holder arm that holds the drive unit in a tilted up position when desired.

An outboard drive unit, which may comprise an outboard motor or the outboard drive portion of an inboard/outboard drive, typically employs an arrangement for supporting the drive unit for pivotal movement about a generally horizontally extending tilt axis. This pivotal movement is provided to adjust the trim of the drive unit to suit varied running conditions, as well as to tilt up the drive unit to an out-of-the-water position for servicing, storage, trailering or the like. It is also conventional practice to employ some form of mechanical locking and holding mechanism to maintain the outboard drive unit in the tilted down position under normal running conditions and to hold the outboard drive in its tilted up position when desired.

One such mechanism employs a lock arm which is supported on a swivel bracket of the drive unit and is adapted to releasably engage a pin on the clamp bracket of the drive unit. A holder arm is also pivotally supported on the swivel bracket and is engagable with holder portions formed on the clamp bracket for holding the outboard drive unit in a partially or fully tilted up state. A pair of operating levers are also provided, one for engaging and disengaging the lock arm, and the other for effecting movement of the holder arm between an engaged and disengaged position. Although this type of mechanism is generally satisfactory, the use of different operating levers for the locking and holding functions makes adjustment of the drive unit more complicated.

It is, therefore, a principal object of this invention to provide an improved tilting mechanism for an outboard drive unit which includes a tilt locking and holding mechanism, both of which are operated by a single operating lever.

It is another object of this invention to provide an improved tilting mechanism for an outboard drive unit that is simple and easy to use in connection with tilting the outboard drive unit yet highly effective.

SUMMARY OF THE INVENTION

This invention is adapted to be embodied in a tilting mechanism for an outboard drive unit that comprises a clamp bracket having a holder portion and which is adapted to be affixed to the transom of an associated watercraft. A swivel bracket is pivotally connected to the clamp bracket for tilting movement about a tilt shaft between a tilted down position and a tilted up position. The clamp bracket has a stop member secured to it which is engagable with the swivel bracket for setting a tilted down position of the swivel bracket and the outboard drive unit. There is provided locking means pivotally mounted on the swivel bracket for selectively engaging the stop member for releasably retaining the swivel bracket in a tilted down position. The tilting mechanism further includes holding means pivotally supported on the swivel bracket for selectively engaging the holder portion of the clamp bracket for releasably holding the swivel bracket in a tilted up position. There is a single operating lever pivotally supported on the swivel bracket and means for connecting the operating lever with the locking means and the holding means respectively. In accordance with the invention, this operating lever is movable between a first position wherein the locking means is engaged with the stop member and the holding means is urged away from the holder portion of the clamp bracket, a second position wherein the locking means is disengaged from the stop member, and a third position wherein the holding means is urged toward the holder portion of the clamp bracket and adapted for engagement with the holder portion when the swivel bracket is tilted up.

In one embodiment, when the operating lever is in the second position, the holding means is urged away from the holder portion of the clamp bracket, and when the operating lever is in the third position, the locking means is disengaged from the stop member.

In a second embodiment, when the operating lever is in the second position, the holding means is urged away from the holder portion of the clamp bracket, and when the operating lever is in the third position, the locking means is engaged with the stop member.

In a third embodiment, when the operating lever is in the second position, the holding means is urged toward the holder portion of the clamp bracket, and when the operating lever is in the third position, the locking means is engaged with the stop member.

BRIEF DESCRIPTION OF THE DRAWINGS

FIG. 10 is a chart showing the positions of the lock arm and holder arm with respect to the position of the operating lever according to the embodiment of FIGS. 3 through 7.

FIG. 11 is a chart showing the positions of the lock arm and holder arm with respect to the position of the operating lever in accordance with a second embodiment of the invention.

FIG. 12 is a chart showing the positions of the lock arm and holder arm with respect to the position of the operating lever in accordance with a third embodiment of the invention.

DETAILED DESCRIPTION OF THE PREFERRED EMBODIMENTS OF THE INVENTION

Figure 1:
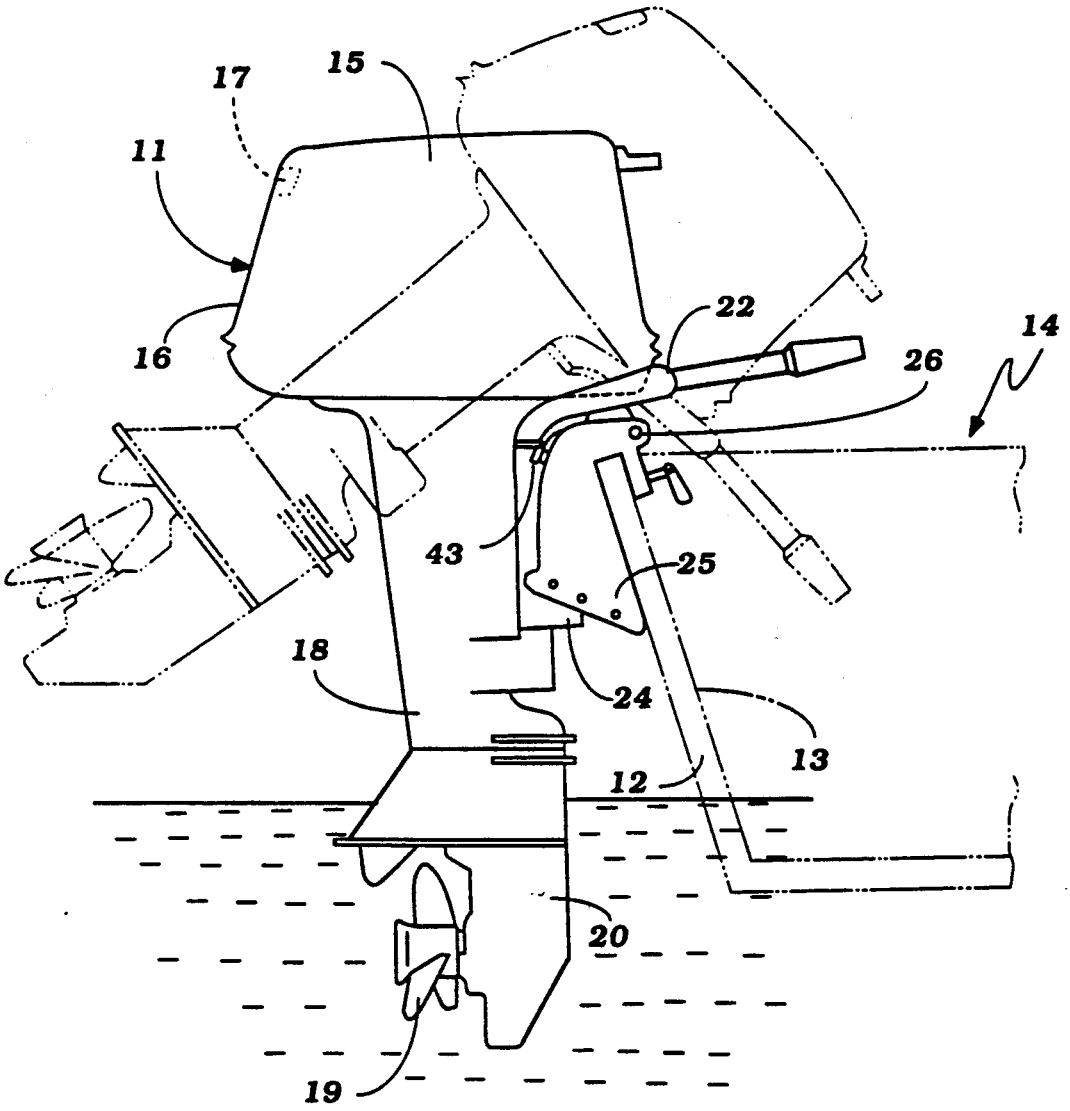
FIG. 1 is a side elevational view of an outboard motor, attached to the transom of an associated watercraft, shown in the tilted down position in solid lines and in the tilted up position in phantom, and embodying a tilting mechanism constructed in accordance with, embodiments of the invention.

Referring first to FIG. 1, an outboard drive unit in the form of an outboard motor, indicated generally by the reference numeral 11 and constructed in accordance with embodiments of the invention, is mounted on a transom 12 of a hull 13 of an associated watercraft 14. Although the invention is described in conjunction with an outboard motor, it is to be understood that the invention may equally as well be practiced with the outboard drive portion of an inboard/outboard drive. However, the invention has particular utility in connection with an outboard motor.

The outboard motor 11 is comprised of a power head, indicated generally by the reference numeral 15, which includes an internal combustion engine (not shown) and a surrounding protective cowling, identified by the reference numeral 16. An air inlet 17 is formed in an upper rear portion of the cowling 16 for supplying atmospheric air to the engine's induction system. The engine, which may be of any conventional type, has an output shaft that drives a driveshaft journaled for rotation within a driveshaft housing 18 and which drives a propeller 19 of a lower unit 20 through a conventional forward, neutral, reverse transmission (not shown).

A steering shaft 21 (see FIG. 3) is affixed to a steering bracket 22 that is attached to the driveshaft housing 18 and is journaled within a swivel bracket 24 for steering of the outboard motor 11 about a generally vertically extending steering axis. The swivel bracket 24 is, in turn, connected for pivotal movement to a clamp bracket 25 by means of a tilt shaft 26 for tilt and trim adjustment of the outboard motor 11.

Referring now, in addition to FIG. 1, to FIGS. 2 through 7 wherein a first embodiment of the invention is illustrated, the clamp bracket 25 has a series of trim apertures extending laterally therethrough for receiving a lock/stop pin 27 which is engagable with a projection 28 of the swivel bracket 24 for setting the tilted down position of the swivel bracket 24 and outboard motor 11. Thus, the angle of the outboard motor 11 with respect to the transom 12 of the watercraft 14 may be selectively varied by the operator in accordance with desired operating conditions by inserting the stop pin 27 in the appropriate aperture in the clamp bracket 25.

Figure 3:
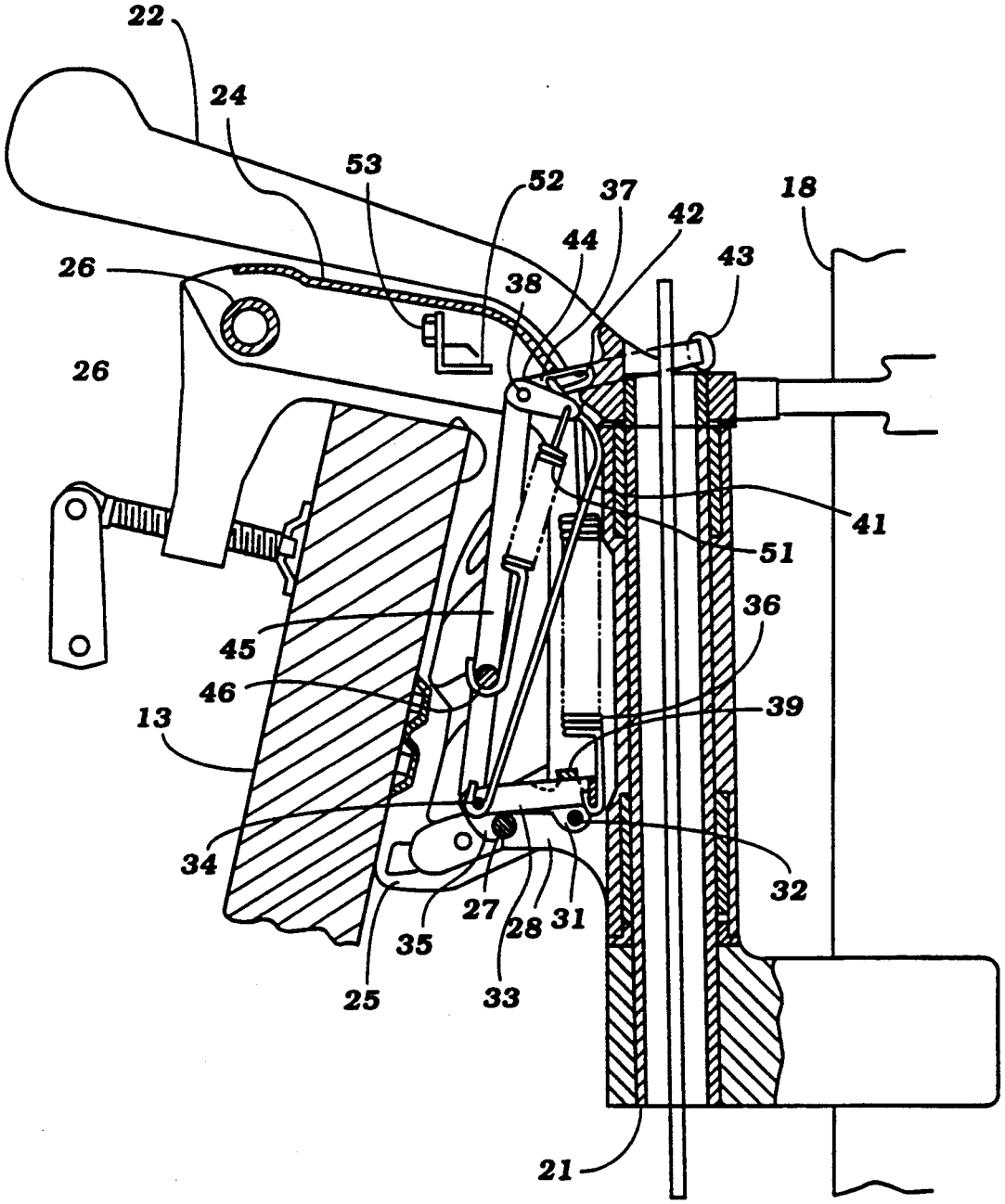
FIG. 3 is an enlarged side elevational view of a first embodiment of the tilting mechanism, with portions broken away and other portions shown in cross section, showing the swivel bracket in its tilted down, locked state and the operating lever in its first position.

Locking means are provided on the swivel bracket 24 for releasably engaging the lock pin 27 to retain the swivel bracket 24 and outboard motor 11 in a selected tilted down position under normal running conditions of the motor 11 and to prevent the motor from popping up when operating in reverse. This releasable locking means comprises a lever 31 which is pivotally mounted at one end on the swivel bracket 24 by means of a pivot pin 32. A lock arm 33 is mounted at one end on the lever 31 opposite the pin 32 by means of a pin 34. At the same end, the lock arm 33 has a latch 35 that defines a recess that is adapted to selectively engage the lock pin 27 so as to retain the motor 11 in a selected downward running position, as shown in FIG. 3. A spring 36 is connected between the end of the lock arm 33 opposite the lock pin 27 and the swivel bracket 24. This spring 36 exerts an upward force on the end of the lock arm 33 opposite the pin 27 which causes an upper surface of the lock arm 33 also opposite the pin 27 to forcibly to bear against a tang 39 formed on the lever 31 to hold the lock arm 33 in its locked position under normal, forward running conditions. A spring may also be used to urge the lever 31 in a counterclockwise direction to further assist in retaining the swivel bracket 24 and outboard motor 11 in a tilted down position.

A release link 41 is connected at its lower end to the pin 34 and is engaged at its upper end with a slot 42 formed in a first rocking arm 37 which is fixed on a support shaft 38 that is, in turn, rotatably supported by the swivel bracket 24. This release link 41 and first rocking arm 37 are adapted for manually releasing the lock arm 33 from the lock pin 27 to permit tilting up of the outboard motor 11. This is accomplished by pivotal movement of an operating lever which is mounted on the support shaft 38 and identified by the reference numeral 43, as hereinafter described.

Figure 2:
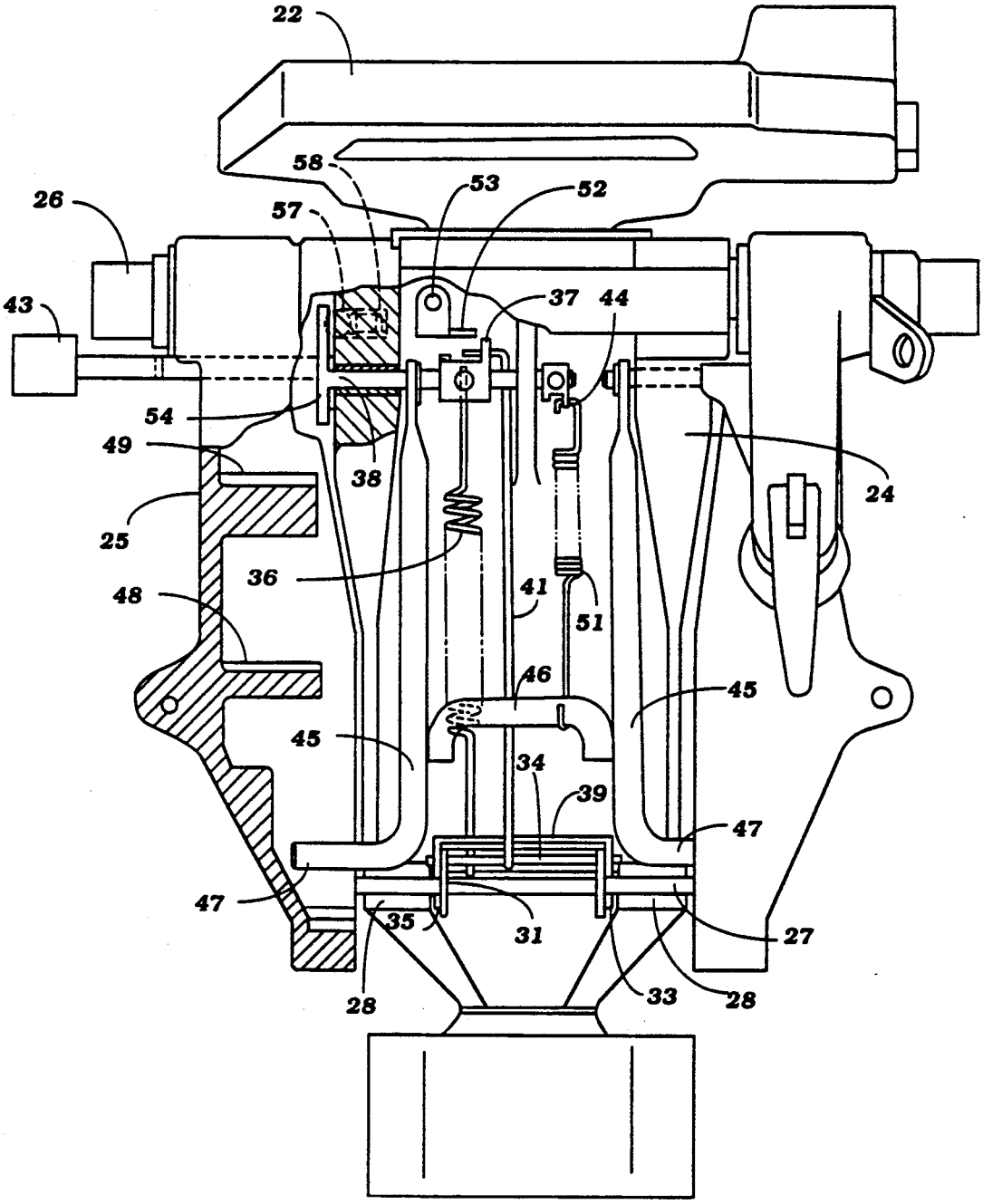
FIG. 2 is an enlarged front view of a first embodiment of the tilting mechanism, with portions broken away and other portions shown in cross section.

In addition to locking means, the tilting mechanism is also equipped with means for holding the swivel bracket 24 and outboard motor 11 in a desired tilted up position. This holding means is actuated in conjunction with the locking means and is comprised of a second rocking arm 44 which, like the first rocking arm 37, is fixed on the support shaft 38 for rotation therewith. This holding means further comprises a holder arm 45 which includes a pair of generally L-shaped members that are each mounted at one end on the support shaft 38, as shown in FIG. 2, for independent rotation with respect to the shaft 38. These L-shaped members are interconnected by a U-shaped member 46 so that they will pivot as a unit. Each of these L-shaped members has a horizontal segment 47 at its other end which extends outwardly in the opposite direction from its counterpart. These horizontal segments 47 are selectively engagable with a series of notched holder portions 48 and 49 formed in rearwardly extending plate portions of the clamp bracket 25. A spring 51 extends between the U-shaped member 46 and the second rocking arm 44 for urging the holder arm 45 either away from or toward the notched portions 48 and 49.

The operation of the tilting mechanism will now be described with particular reference to FIGS. 3 through 7 and 10. When the operating lever 43 is in a first position, the swivel bracket 24 and outboard motor 11 are in a tilted down and locked position, as shown in FIGS. 3 and 10. It will also be noted that the holder arm 45 is being urged away from the notched holder portions 48 and 49 of the clamp bracket 25 when the operating lever 43 is in this first position.

Figure 4:
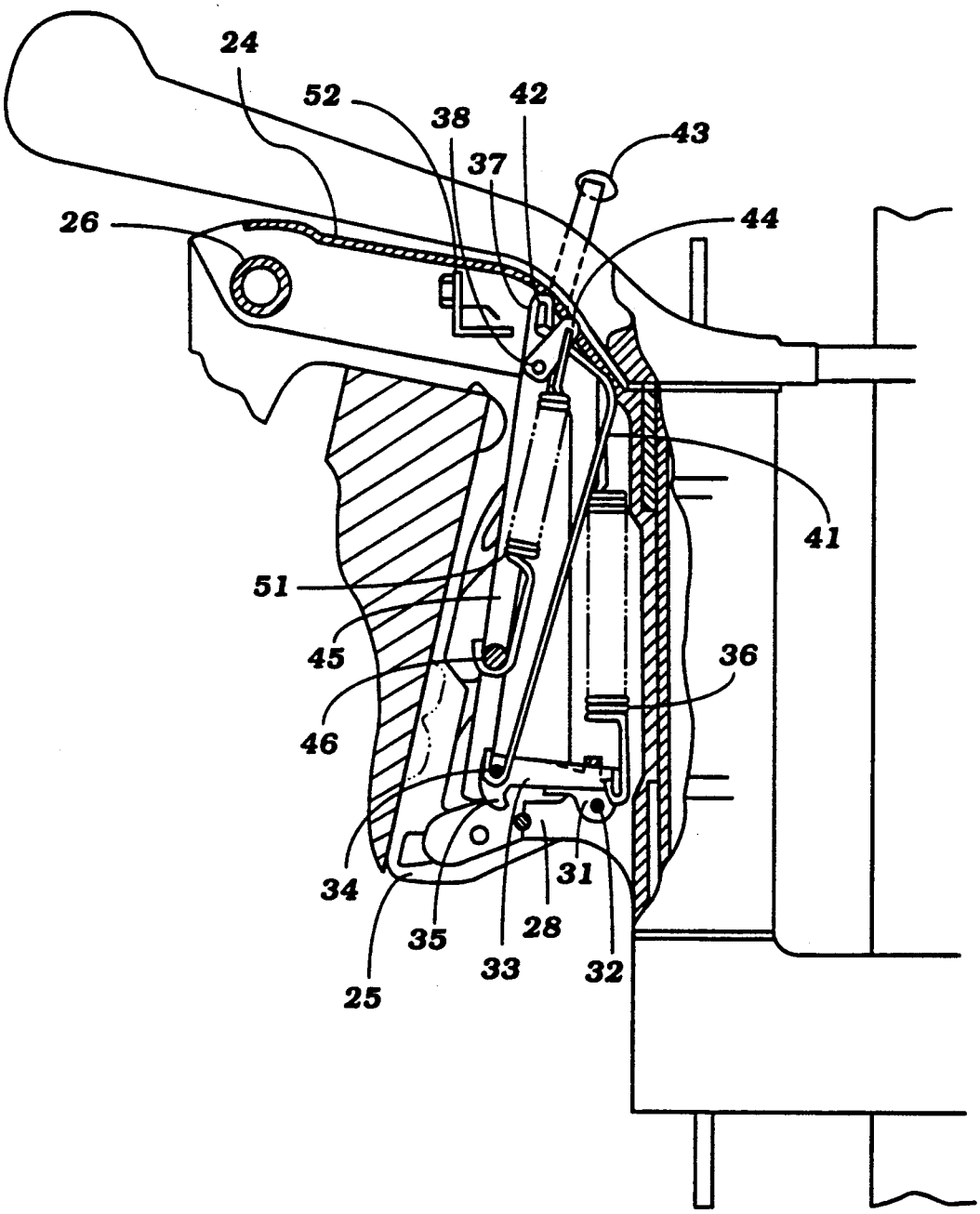
FIG. 4 is an enlarged side elevational view of a first embodiment of the tilting mechanism, with portions broken away and other portions shown in cross section, showing the swivel bracket in its tilted down, unlocked state and the operating lever in its second position.

To release the lock arm latch 35 from the lock pin 27, the operating lever 43 is moved to its second position, as shown in FIG. 4. When this occurs, the first rocking arm 37 will rotate in a counterclockwise direction, as shown in FIG. 4, along with the support shaft 38. Rotation of the first rocking arm 37 in this manner places a tension on the release link 41 to draw the lock arm latch 35 in an upward, clockwise direction against the spring force exerted on lever 31 to release the latch 35 from the lock pin 27. Movement of the operating lever 43 from the first position to the second position also causes the second rocking arm 44 to rotate counterclockwise. However, even with such rotation, the spring 51 continues to urge the holder arm 45 away from the notched holder portions 48 and 49, as shown in FIGS. 4 and 10.

Figure 5:
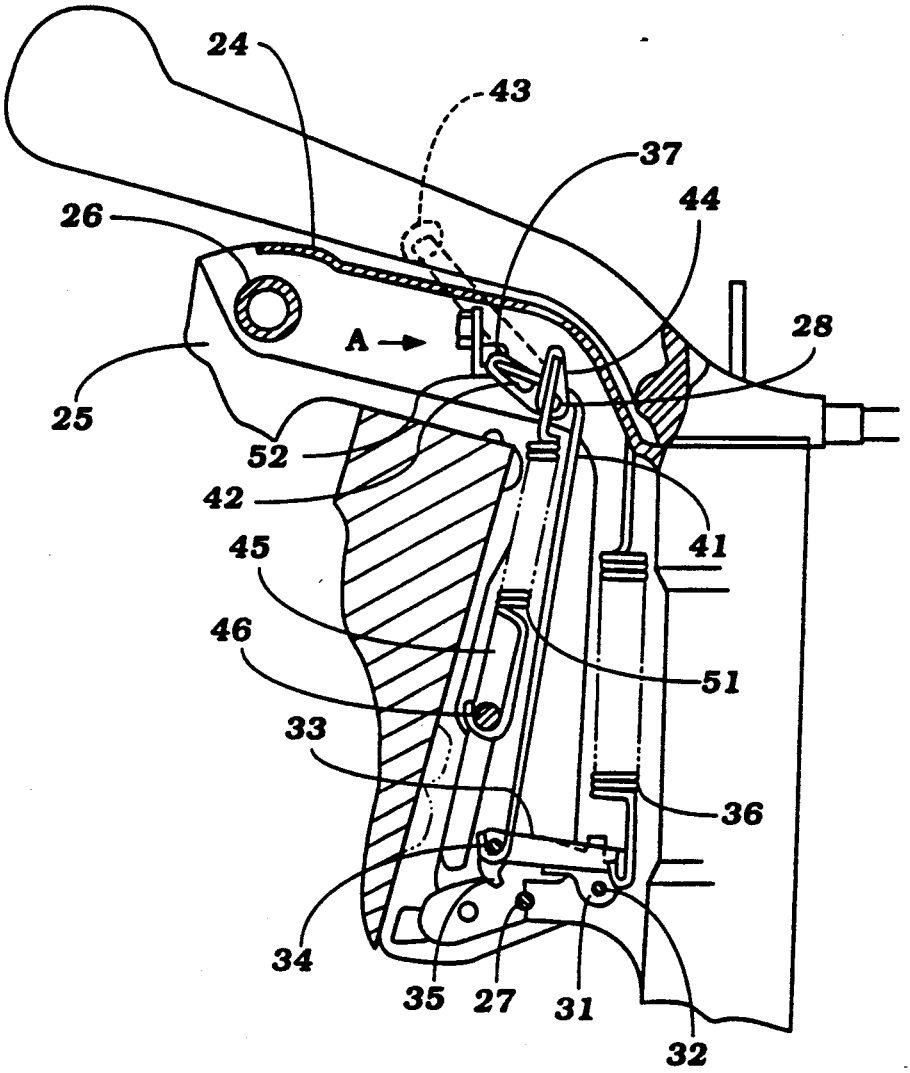
FIG. 5 is an enlarged side elevational view of a first embodiment of the tilting mechanism, with portions broken away and other portions shown in cross section, showing the swivel bracket in its tilted down, unlocked state and the operating lever in its third position.
Figure 5A:
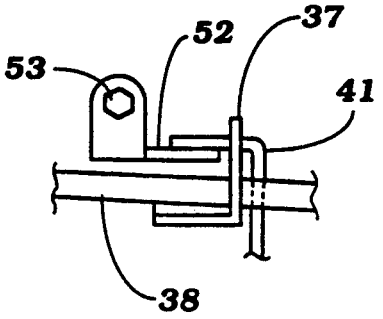
FIG. 5A is a cross sectional view taken in the direction of arrow A in FIG. 5.

The outboard motor 11 may now be tilted up, although the holder arm 45 would still be urged away from the holder portions 48 and 49. In order to place the holder arm 45 in its operative position, the operating lever 43 is moved to its third position as shown in FIG. 5. This causes the second rocking arm 44 to rotate further in the counterclockwise direction so that the spring 51 is positioned to urge the holder arm 45 toward the notched holder portions 48 and 49, as seen in FIGS. 5 and 10. The holder arm 45 is now in position to engage one of the notched holder portions 48 or 49. Although the first rocking arm 37 will also rotate further in the counterclockwise direction when the operating lever 43 is moved from its second to its third position, such rotation will not cause the lock arm latch 35 to change position, as shown in FIG. 10. Rather, with further counterclockwise rotation of rocking arm 37, the upper end of the release link 41, will slide forwardly within the slot 42 of the rocking arm 37 and engage with the upper surface of a ledge 52 that is affixed to the swivel bracket 24 by means of a bolt 53, as shown in FIGS. 5 and 5A.

The operating lever 43 may be shifted from its second to its third position before tilting up the motor 11, during the tilting up process, or after the motor has been fully tilted up. If, for example, the lever 43 is moved into its third position from its second position before tilting up, the holder arm 45 will pivot toward the clamp bracket 25 so that the horizontal segments 47 of the holder arm 45 will rise along the plate portions of the clamp bracket 25 when the motor 11 is tilted up. To engage the holder arm 45, the motor 11 is tilted up to a point slightly above the selected holder notch 48 or 49 and then lowered slightly so that the horizontal segments 47 engage the selected notch 48 or 49 to hold the swivel bracket 24 and outboard motor 11 in a selected tilted up position.

Figure 6:
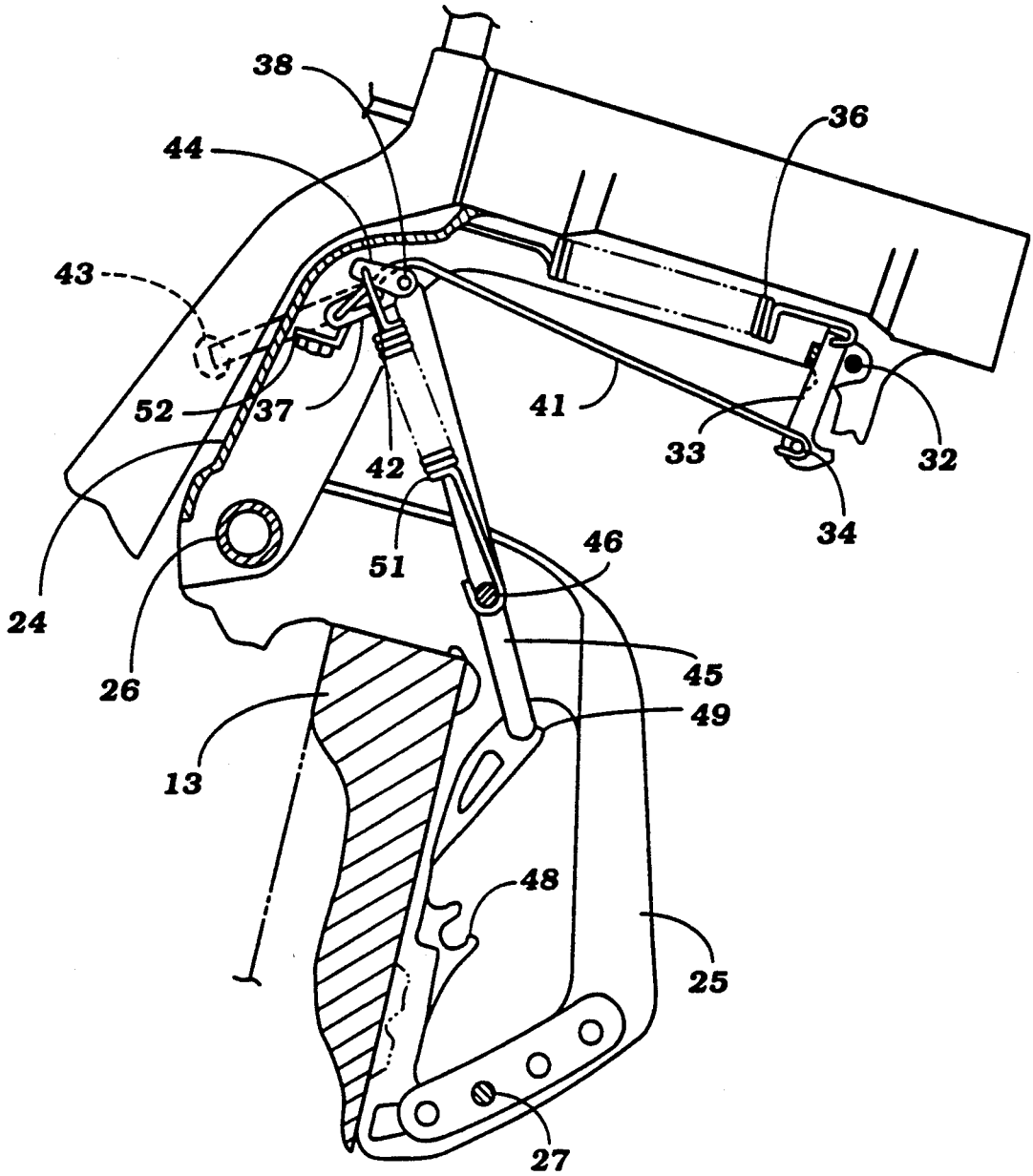
FIG. 6 is an enlarged side elevational view of a first embodiment of the tilting mechanism, with portions broken away and other portions shown in cross section, showing the swivel bracket in its tilted up, unlocked state with the holder arm in engagement with the clamp bracket holder portion and the operating lever in its third position.

The outboard motor 11 is shown in a tilted up position in FIG. 6, with the holder arm 45 engaged with the upper notched holder portion 49. In the preferred embodiment, the lower notched portion 48 is positioned so that when the watercraft 14 is in the water and the holder arm 45 is engaged with that notched portion 48, the propeller 19 is still positioned below the water surface. With this arrangement, the lower notched portion 48 may be used for running the motor 11 in shallow water.

Figure 7:
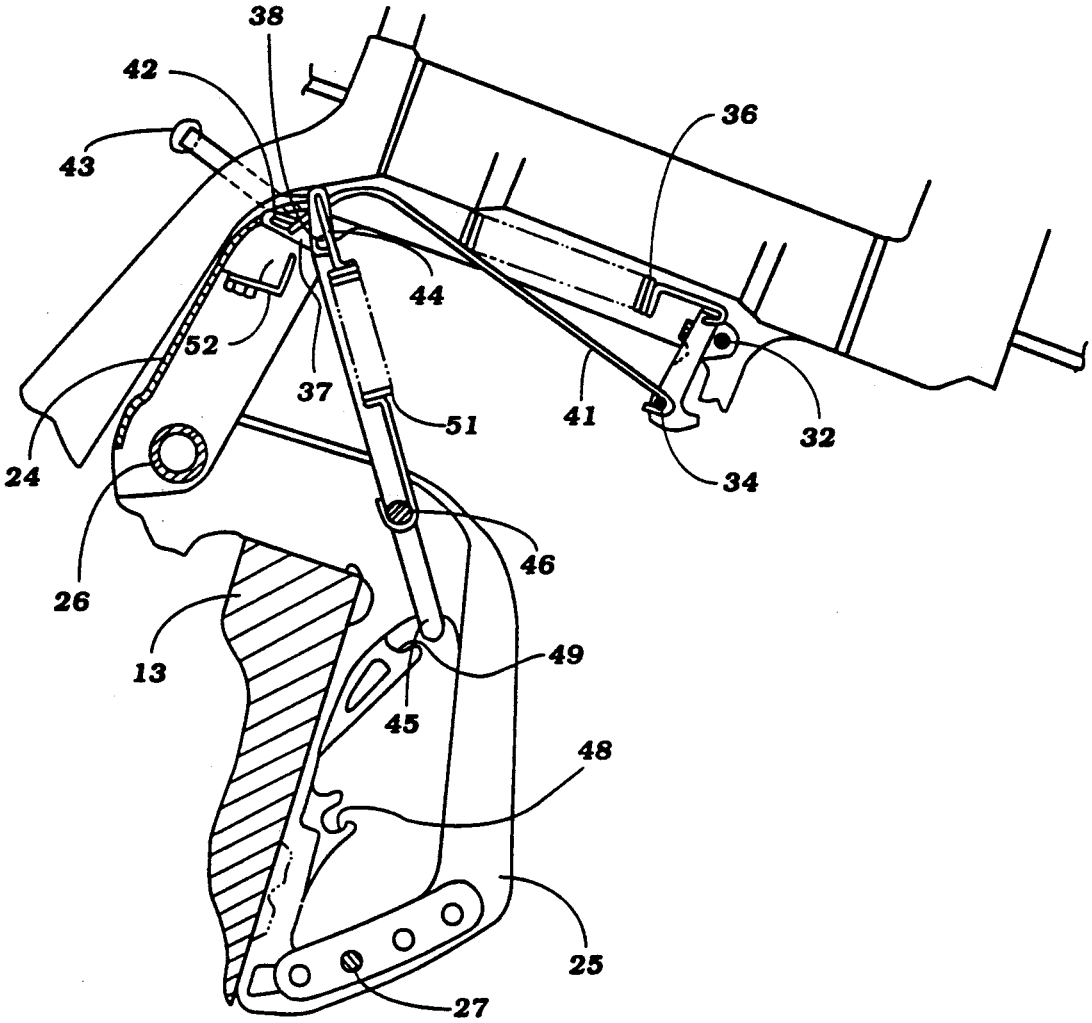
FIG. 7 is an enlarged side elevational view of a first embodiment of the tilting mechanism, with portions broken away and other portions shown in cross section, showing the swivel bracket in its tilted up, unlocked state with the holder arm disengaged from the clamp bracket holder portion and the operating lever in its second position.

To lower the outboard motor 11, it is first raised slightly and the operating lever 43 is shifted to its second position, as shown in FIG. 7, so as to release the holder arm 45 from the holder portion 48 or 49. The outboard motor 11 may then be returned to a normal tilted down running position. Once the swivel bracket projection 28 engages the stop pin 27, the operating lever 43 may be further shifted to its first position wherein the lock arm latch 35 engages with the pin 27 to retain the outboard motor 11 in the selected tilted down running position.

Figure 8:
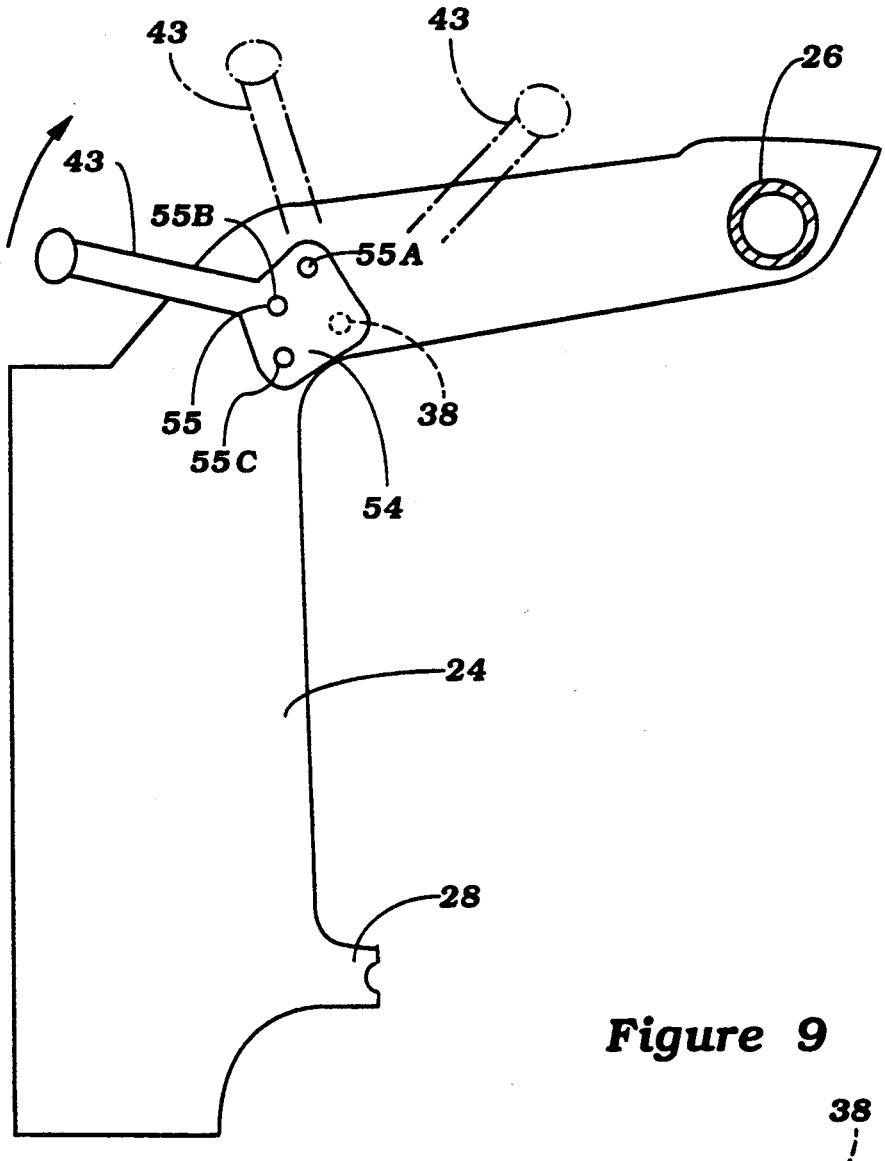
FIG. 8 is a side view of the operating lever shown in its first operative position in solid lines and in its second and third positions in phantom.
Figure 9:
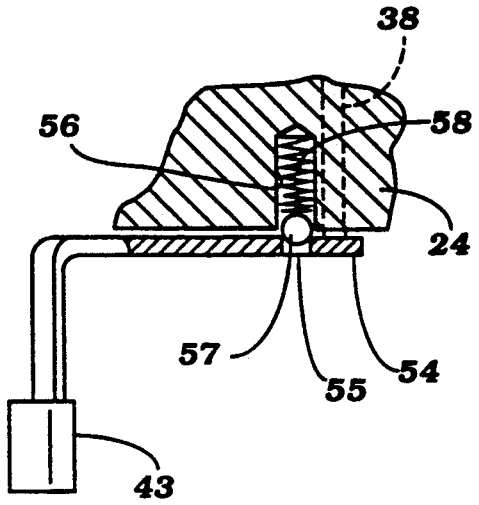
FIG. 9 is a side view showing the detent mechanism of the operating lever.

Referring now to FIGS. 8 and 9 where the details of the operating lever 43 are illustrated, it will be seen that this lever 43 has a body portion 54 that is mounted on one end of the support shaft 38 which defines the pivot axis of the lever 43. The operating lever 43 is also provided with a handle at the end opposite the body portion 54 which extends outwardly and generally perpendicular to the body 54. In accordance with a feature of the invention, a detent mechanism is provided for setting the three operative positions of the lever 43 and for maintaining the lever 43 in a selected position. To this end, there are three apertures 55, one corresponding to each lever position, which extend through the body portion 54 and which are adapted to be brought into and out of alignment with a bore 56 that is formed in the swivel bracket 24. These apertures 55 act as seats for a ball type member 57 which is urged into contact with the body member 54 by a spring 58 that is positioned within the bore 56. As such, the ball 57 is adapted to seat within each of the apertures 55, as shown in FIG. 9, as each aperture is brought into alignment with the bore 56 so as to fix each of the operative positions of the lever 43. With this arrangement, when the lever 43 is in its first position, as shown in solid lines in FIG. 8, aperture 55A will be aligned with the bore 56 and engaged by the ball 57. When the lever 43 is shifted to its second or third position, as shown in phantom in FIG. 8, the aperture 55B or 55C respectively will be aligned with the bore 56 and engaged by the ball 57. It should be noted that, although the detent mechanism is sufficient for preventing inadvertent movement of the operating lever 43 once it is set in a selected position, it is also constructed so that the ball 57 can be easily unseated from the apertures 55 when the operator shifts the lever 43.

A second embodiment of the tilting mechanism is depicted in FIG. 11. This tilting mechanism of the second embodiment is generally similar to the tilting mechanism described in connection with the first embodiment, except that the rocking arm 37 is not formed with a slot 42 and there is no ledge 52 affixed to the swivel bracket 24. Thus, when the operating lever 43 is shifted from its second to its third position, the first rocking arm 37 will rotate further, causing the lock arm latch 35 to move from its released position to its locked position. As is the case with the first embodiment, the outboard motor 11 may be freely tilted up or down when the lever 43 is in its second position. However, the outboard motor 11 may not be tilted up from its fully downward position after the lever 43 is shifted to its third position; the motor 11 must be at least partially tilted up while the lever 43 is in its second position. Once the outboard motor 11 is at least partially tilted up, it may be held in a selected tilted up position by shifting the lever 43 to the third position.

While the second embodiment has the advantage of reduced cost by eliminating the ledge, the first embodiment has the advantage that the outboard motor 11 can be tilted up from its fully downward position when the operating lever 43 is in its third position, in which case the horizontal segments 47 automatically engage with the holder portions 48 or 49.

A third embodiment of the tilting mechanism is shown in FIG. 12, which is generally similar to the tilting mechanism described in connection with the first embodiment, except that the second rocking arm 44 is fixed on the support shaft 38 with the end of the arm 44 opposite the shaft 38 positioned and further in the counterclockwise direction, as viewed in FIGS. 3 through 5, such that movement of the operating lever 43 from the first to the second position causes the spring 51 to urge the holder arm 45 toward the notched holder portions 48 and 49. In this case, the spring 51 will continue to urge the holder arm 45 toward the notched holder portions 48 and 49 when the rocking arm 44 is rotated further in the counterclockwise direction upon movement of the lever 43 from the second to third position. As with the second embodiment, the first rocking arm 37 does not have a slot 42 and there is no ledge 52 in the tilting mechanism.

In this third embodiment, the outboard motor 11 can be tilted up from its tilted down position by setting the lever 43 in its second position and can be returned to the tilted down position from a tilted up position by shifting the lever 43 back to the first position.

The operating lever 43 can be set in the third position when cruising. Thus, in the event that the lower unit 20 of the outboard motor 11 strikes an obstacle with sufficient force, the motor 11 will pop up, at which time the horizontal segments 47 will engage the holder portion 48 or 49. With this arrangement, the watercraft 14 can be stopped soon after the motor 11 hits the obstacle.

It should be readily apparent from the foregoing description that embodiments of a highly effective yet simple and easy to use tilt retaining and holding mechanism operable by a single operating lever has been illustrated and described. Although this is the case, it is to be understood that various changes and modifications may be made without departing from the spirit and scope of the invention, as defined by the appended claims.

I claim:

1. A tilting mechanism for an outboard drive unit comprising a clamp bracket having a holder portion and adapted to be affixed to the transom of an associated watercraft, a tilt shaft, a swivel bracket pivotally connected to said clamp bracket for tilting movement about said tilt shaft between a tilted down position and a tilted up position, a stop member secured to said clamp bracket and engageable with said swivel bracket for setting a tilted down position of said swivel bracket, locking means pivotally mounted on said swivel bracket for selectively engaging said stop member for releasably retaining said swivel bracket in a tilted down position, holding means pivotally supported on said swivel bracket for selectively engaging the holder portion of said clamp bracket for releasably holding said swivel bracket in a tilted up position, a single operating lever pivotally supported on said swivel bracket for controlling said locking means and said holding means, means for connecting said single operating lever with said locking means, and means for connecting said single operating lever with said holding means, said single operating lever being movable between a first position wherein said locking means is engaged with said stop member and said holding means is urged away from the holder portion of said clamp bracket, a second position wherein said locking means is disengaged from said stop member, and a third position wherein said holding means is urged toward the holder portion of said clamp bracket and adapted for engagement with the holder portion when said swivel bracket is tilted up.

2. A tilting mechanism as recited in claim 1, wherein when said single operating lever is in said second position said holding means is urged away from the holder portion of said clamp bracket.

3. A tilting mechanism as recited in claim 2, wherein when said single operating lever is in said third position said locking means is disengaged from said stop member.

4. A tilting mechanism as recited in claim 2, wherein when said single operating lever is in said third position said locking means is engaged with said stop member.

5. A tilting mechanism as recited in claim 1, further comprising a support shaft rotatably supported by said swivel bracket wherein said single operating lever is mounted on said support shaft.

6. A tilting mechanism as recited in claim 5, wherein said means for connecting said single operating lever with said locking means comprises a release link and a first rocking arm fixed on said support shaft.

7. A tilting mechanism as recited in claim 6, wherein said locking means comprises a lock arm having a latch portion for selectively engaging said stop member for releasably retaining said swivel bracket in a tilted down position.

8. A tilting mechanism as recited in claim 5, wherein said means for connecting said single operating lever with said holding means comprises a spring and a second rocking arm fixed on said support shaft.

9. A tilting mechanism as recited in claim 8, wherein said holding means comprises a holder arm.

10. A tilting mechanism as recited in claim 1, further comprising a detent mechanism for setting the three operative positions of said operating lever.

11. A tilting mechanism as recited in claim 10, wherein said single operating lever has a plurality of apertures extending therethrough and said swivel bracket has a bore formed therein and wherein said detent mechanism comprises a spring positioned in said bore and a ball type member in contact with said spring and selectively engagable with each of said apertures as each aperture is brought into alignment with said bore.

12. A tilting mechanism as recited in claim 11, further comprising a support shaft rotatably supported by said swivel bracket wherein said single operating lever is mounted on said support shaft.

13. A tilting mechanism as recited in claim 12, wherein said means for connecting said single operating lever with said locking means comprises a release link and a first rocking arm fixed on said support shaft.

14. A tilting mechanism as recited in claim 12, wherein said means for connecting said single operating lever with said holding means comprises a spring and a second rocking arm fixed on said support shaft.

15. A tilting mechanism as recited in claim 1, wherein when said single operating lever is in said second position said holding means is urged toward the holder portion of said clamp bracket.

16. A tilting mechanism as recited in claim 15, wherein when said single operating lever is in said third position said locking means is engaged with said stop member.

* * * * *